US010407759B2

(12) United States Patent
Naumann et al.

(10) Patent No.: US 10,407,759 B2
(45) **Date of Patent: *Sep. 10, 2019**

(54) COST REDUCED STEEL FOR HYDROGEN TECHNOLOGY WITH HIGH RESISTANCE TO HYDROGEN-INDUCED EMBRITTLEMENT

(71) Applicant: Bayerische Motoren Werke Aktiengesellschaft, Munich (DE)

(72) Inventors: Joerg Naumann, Neufahrn (DE); Wolfgang Leistner, Munich (DE); Werner Theisen, Hattingen (DE); Sebastian Weber, Essen (DE); Thorsten Michler, Wiesbaden (DE); Mauro Martin, Bochum (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 349 days.

This patent is subject to a terminal disclaimer.

(21) Appl. No.: 14/267,468

(22) Filed: May 1, 2014

(65) Prior Publication Data

US 2014/0234153 A1 Aug. 21, 2014

Related U.S. Application Data

(63) Continuation of application No. PCT/EP2012/071601, filed on Oct. 31, 2012.

(30) Foreign Application Priority Data

| | | |
|---|---|---|
| Nov. 2, 2011 | (DE) | 10 2011 054 992 |
| Jan. 27, 2012 | (DE) | 10 2012 100 686 |
| May 16, 2012 | (DE) | 10 2012 104 254 |

(51) Int. Cl.

| | |
|---|---|
| ***C22C 38/02*** | (2006.01) |
| ***C22C 38/58*** | (2006.01) |
| ***C22C 38/06*** | (2006.01) |
| ***C22C 38/42*** | (2006.01) |
| ***C22C 38/54*** | (2006.01) |
| ***C22C 38/00*** | (2006.01) |
| ***C22C 38/44*** | (2006.01) |

(52) U.S. Cl.

CPC ..... *C22C 38/58* (2013.01); *C22C 38/005* (2013.01); *C22C 38/02* (2013.01); *C22C 38/06* (2013.01); *C22C 38/42* (2013.01); *C22C 38/44* (2013.01); *C22C 38/54* (2013.01)

(58) Field of Classification Search

CPC ..... C22C 38/005; C22C 38/02; C22C 38/04; C22C 38/06; C22C 38/42; C22C 38/44; C22C 38/54; C22C 38/58

USPC ..... 420/44

See application file for complete search history.

(56) References Cited

U.S. PATENT DOCUMENTS

| | | | | |
|---|---|---|---|---|
| 3,723,102 | A | 3/1973 | Lowe | |
| 8,303,733 | B2 * | 11/2012 | Hamada | C21D 6/002 148/325 |
| 2008/0292489 | A1 | 11/2008 | Yamamoto et al. | |
| 2011/0064649 | A1 | 3/2011 | Semba et al. | |
| 2011/0250522 | A1 * | 10/2011 | Kaminaka | C22C 38/40 429/479 |

FOREIGN PATENT DOCUMENTS

| | | | |
|---|---|---|---|
| CN | 1833043 | A | 9/2006 |
| DE | 2 417 632 | A1 | 11/1974 |
| EP | 0 735 154 | A1 | 10/1996 |
| EP | 2 226 406 | A1 | 8/2010 |
| FR | 743 179 | A | 3/1933 |
| GB | 2 073 249 | A | 10/1981 |
| JP | 06184699 | A | 7/1994 |

OTHER PUBLICATIONS

English translation of Chinese Office Action dated Jun. 17, 2015 (Six (6) pages).

International Search Report dated Mar. 5, 2013 with English translation (seven (7) pages).

Weber, et al., "Lean-alloyed austenitic stainless steel with high resistance against hydrogen environment embrittlement", Materials Science and Engineering A, Jun. 16, 2011, Elsevier, vol. 528, No. 25, pp. 7688-7695, XP 028258900 (Eight (8) pages).

German Office Action dated Sep. 10, 2012 (Two (2) pages).

Fukuyama et al. "Effect of Temperature on Hydrogen Environment Embrittlement of Type 316 Series Austenitic Stainless Steel at Low Temperatures" *J. Japan Inst. Metals*, vol. 67, No. 9 (2003), pp. 456-459.

* cited by examiner

*Primary Examiner* — Jie Yang

(74) *Attorney, Agent, or Firm* — Crowell & Moring LLP

(57) ABSTRACT

A corrosion-resistant, hot and cold formable and weldable steel for use in hydrogen-induced technology with high resistance to hydrogen embrittlement has the following composition: 0.01 to 0.4 percent by mass of carbon, ≤3.0 percent by mass of silicon, 0.3 to 30 percent by mass of manganese, 10.5 to 30 percent by mass of chromium, 4 to 12.5 percent by mass of nickel, ≤1.0 percent by mass of molybdenum, ≤0.2 percent by mass of nitrogen, 0.5 to 8.0 percent by mass of aluminum, ≤4.0 percent by mass of copper, ≤0.1 percent by mass of boron, ≤1.0 percent by mass of tungsten, ≤5.0 percent by mass of cobalt, ≤0.5 percent by mass of tantalum, ≤2.0 percent by mass of at least one of the elements: niobium, titanium, vanadium, hafnium and zirconium, ≤0.3 percent by mass of at least one of the elements: yttrium, scandium, lanthanum, cerium and neodymium, the remainder being iron and smelting-related steel companion elements.

12 Claims, No Drawings

COST REDUCED STEEL FOR HYDROGEN TECHNOLOGY WITH HIGH RESISTANCE TO HYDROGEN-INDUCED EMBRITTLEMENT

CROSS REFERENCE TO RELATED APPLICATIONS

This application is a continuation of PCT International Application No. PCT/EP2012/071601, filed Oct. 31, 2012, which claims priority under 35 U.S.C. § 119 from German Patent Application No. 10 2011 054 992.7, filed Nov. 2, 2011, German Patent Application No. 10 2012 100 686.5, filed Jan. 27, 2012, and German Patent Application No. 10 2012 104 254.3, filed May 16, 2012, the entire disclosures of which are herein expressly incorporated by reference.

BACKGROUND OF THE INVENTION

The invention relates to a corrosion-resistant steel with high resistance to hydrogen-induced embrittlement over the entire temperature range (−253° C. to at least +100° C.), in particular between −100° C. and room temperature (+25° C.). The proposed steel is suited for all metallic components which are in contact with hydrogen such as, for example, hydrogen tanks, liners, bosses, valves, pipes, springs, heat exchangers, fittings or bellows.

Steel which is exposed over a longer period of time to mechanical stress in a hydrogen atmosphere is subjected to hydrogen embrittlement. Stainless austenitic steels with a high nickel content such as material no. 1.4435, X2CrNiMo18-14-3 constitute an exception. In case of such austenitic steels, a nickel content of at least 12.5 percent by mass is considered to be necessary in order to achieve sufficient resistance to hydrogen embrittlement over the entire temperature range (−253° C. to at least +100° C.) and pressure range (0.1 to 87.5100 MPa). However, like molybdenum, nickel is a very expensive alloying element so that cost-effective, hydrogen-resistant steels are especially missing for the mass production of, for example, tank components in the motor vehicle sector.

It is therefore the object of the invention to provide a cost-effective steel which is resistant to hydrogen-induced embrittlement over the entire temperature range, in particular in the range of maximum hydrogen embrittlement between room temperature and −100° C., which has no distinct ductile-brittle transition at low temperatures, which is resistant to corrosion and which has good hot and cold forming and welding capabilities.

SUMMARY OF THE INVENTION

According to the invention, this is achieved with a steel having the following composition:

0.01 to 0.4 percent by mass, preferably ≤0.20 percent by mass, more preferably at least 0.02 percent by mass and in particular 0.06 to 0.16 percent by mass of carbon, ≤3.0 percent by mass, in particular 0.05 to 0.8 percent by mass of silicon, 0.3 to 30 percent by mass, preferably 4 to 20, in particular 6 to 15 percent by mass of manganese, 10.5 to 30 percent by mass, preferably 10.5 to 23 percent by mass, in particular 20 percent by mass of chromium, 4 to 12.5 percent by mass, preferably 5 to 10 percent by mass, in particular at most 9 percent by mass of nickel, ≤1.0 percent by mass, in particular ≤0.40 percent by mass of molybdenum, ≤0.20 percent by mass, in particular ≤0.08 percent by mass of nitrogen, 0.5 to 8.0 percent by mass, preferably at most 6.0 percent by mass, in particular at least 1.5 percent by mass of aluminum, ≤4 percent by mass of copper, in particular 0.3 to 3.5 percent by mass of copper, ≤0.1 percent by mass, preferably at most 0.05 percent by mass, in particular at most 0.03 percent by mass of boron, ≤1.0 percent by mass, in particular ≤0.40 percent by mass of tungsten, ≤3.0 percent by mass, in particular ≤2.0 percent by mass of cobalt, ≤0.5 percent by mass, in particular ≤0.3 percent by mass of tantalum, ≤2.0 percent by mass, preferably 0.01 to 1.5 percent by mass of at least one of the elements: niobium, titanium, vanadium, hafnium and zirconium, ≤0.3 percent by mass, preferably 0.01 to 0.2 percent by mass of at least one of the elements yttrium, scandium, lanthanum, cerium and neodymium, the remainder being iron and smelting-related steel companion elements.

Advantageously, the steel according to the invention provides a corrosion-resistant, hot and cold formable and weldable steel with high resistance to hydrogen-induced embrittlement that may be used for hydrogen technology in motor vehicles.

Other objects, advantages and novel features of the present invention will become apparent from the following detailed description of one or more preferred embodiments when considered in conjunction with the accompanying drawings.

DETAILED DESCRIPTION OF THE INVENTION

According to the invention, a steel is provided having the following composition:

0.01 to 0.4 percent by mass, preferably ≤0.20 percent by mass, more preferably at least 0.02 percent by mass and in particular 0.06 to 0.16 percent by mass of carbon, ≤3.0 percent by mass, in particular 0.05 to 0.8 percent by mass of silicon, 0.3 to 30 percent by mass, preferably 4 to 20, in particular 6 to 15 percent by mass of manganese, 10.5 to 30 percent by mass, preferably 10.5 to 23 percent by mass, in particular 20 percent by mass of chromium, 4 to 12.5 percent by mass, preferably 5 to 10 percent by mass, in particular at most 9 percent by mass of nickel, ≤1.0 percent by mass, in particular ≤0.40 percent by mass of molybdenum, ≤0.20 percent by mass, in particular ≤0.08 percent by mass of nitrogen, 0.5 to 8.0 percent by mass, preferably at most 6.0 percent by mass, in particular at least 1.5 percent by mass of aluminum, ≤4 percent by mass of copper, in particular 0.3 to 3.5 percent by mass of copper, ≤0.1 percent by mass, preferably at most 0.05 percent by mass, in particular at most 0.03 percent by mass of boron, ≤1.0 percent by mass, in particular ≤0.40 percent by mass of tungsten, ≤3.0 percent by mass, in particular ≤2.0 percent by mass of cobalt, ≤0.5 percent by mass, in particular ≤0.3 percent by mass of tantalum, ≤2.0 percent by mass, preferably 0.01 to 1.5 percent by mass of at least one of the elements: niobium, titanium, vanadium, hafnium and zirconium, ≤0.3 percent by mass, preferably 0.01 to 0.2 percent by mass of at least one of the elements yttrium, scandium, lanthanum, cerium and neodymium, the remainder being iron and smelting-related steel companion elements.

The steel according to the invention can thus be produced with or without boron.

The lower limit of the silicon content is generally 0.05 percent by mass and that of copper 0.05 percent by mass.

Among the micro-alloying elements (a) yttrium, scandium, lanthanum, cerium and (b) zirconium and hafnium are of particular relevance.

The alloy according to the invention may have an yttrium content of 0.01 to 0.2, in particular to 0.10 percent by mass, wherein yttrium can fully or partly be replaced by 0.01 to 0.2, in particular to 0.10 percent by mass of one of the elements: scandium, lanthanum or cerium.

Preferably, the hafnium content and the zirconium content are in each case 0.01 to 0.2, in particular to 0.10 percent by mass, wherein hafnium or zirconium can fully or partly be replaced by 0.01 to 0.2, in particular to 0.10 percent by mass of titanium.

The smelting-related steel companion elements comprise conventional production-related elements (e.g. sulfur and phosphorus) as well as further nonspecifically alloyed elements. Preferably, the phosphorus content is ≤0.05 percent by mass, the sulfur content ≤0.4 percent by mass, in particular ≤0.04 percent by mass. The content of all smelting-related steel companion elements is at most 0.3 percent by mass per element.

Due to the reduction of the nickel content to at most 12.5 percent by mass, in particular at most 9 percent by mass, the reduction of the molybdenum content to at most 1.0 percent by mass, preferably at most 0.4 percent by mass, in particular the complete elimination of molybdenum as an alloying element, the alloying costs of the steel according to the invention can be drastically reduced.

Despite the reduction of the nickel content and the absence of molybdenum (i.e. without the addition of molybdenum), the steel according to the invention has very good mechanical properties in a hydrogen atmosphere over the entire temperature range from −253° C. to at least +100° C. and pressure range from 0.1 to 100 MPa.

For example, in a tensile test carried out at a test temperature of −50° C., a gas pressure of hydrogen of 40 MPa and a strain rate of 5×10−5 l/s, the steel according to the invention has a relative reduction area (RRA) (=reduction of area Z in air, argon or helium divided by/reduction of area Z in hydrogen×100%) of at least 80%, preferably at least 90%. The corresponding relative tensile strength R_Rm, the relative yield strength R_Rp0.2 and the relative elongation at break R_A5 are at least 90%. The steel has a very good weldability, no distinct ductile-brittle transition at low temperatures, high resistance to corrosion and very good hot and cold forming capabilities.

The steel according to the invention may be solution annealed (AT). In addition, it can be used when being cold formed, in particular cold drawn or cold rolled.

The steel according to the invention may be a stable austenitic steel with an austenite content of 90 percent by mass. The steel may, however, also be configured in the form of austenitic-ferritic steel (duplex steel). The δ-ferrite content can, for example, be 10 to 90, in particular 10 to 60 percent by volume. It is noteworthy that, even in the case of a high δ-ferrite content, the resistance to hydrogen is very high.

EXAMPLES

A. Example A

For example, the steel A according to the invention with the following composition (as a mass percentage):

0.06 to 0.16% C
0.05 to 0.3% Si
8 to 12% Mn
13.5 to 17.5% Cr
6 to 9% Ni
2.5 to 4.5% Al
0 to 0.04% B, the remainder being iron and smelting-related steel companion elements, has an austenitic-ferritic structure (duplex steel).

The δ-ferrite content of the steel is 15 to 35 percent by volume. In the solution-annealed condition (AT), the yield strength Rp0.2 is more than 500 MPa at a temperature of −50° C. and in a hydrogen atmosphere of 40 MPa. The relative reduction area (=reduction of area Z in helium divided by/reduction of area Z in hydrogen×100%) ranges between 85 and 100%.

The steel according to the invention has a high resistance to hydrogen-induced embrittlement over the entire temperature range from −253° C. to at least +100° C. and pressure range from 0.1 to 100 MPa.

Thus, the steel according to the invention having an austenitic-ferritic structure is a cost-effective, hydrogen-resistant material with high strength for use in hydrogen technology and therefore particularly well suited for springs.

In addition, the steel can be used for devices and components of systems for the generation, storage, distribution and application of hydrogen, in particular in cases where the devices and/or components come into contact with hydrogen. This applies, in particular, to pipes, control devices, valves and other shut-off devices, containers, heat exchangers, bosses and liners, fittings, pressure sensors etc., including parts of said devices, for example springs and bellows.

Due to the high yield strength Rp0.2 of the steel according to the invention, the weight of the aforementioned components can be reduced significantly, thus reducing the fuel consumption.

B. Example B

The steel B according to the invention with the following composition (as a mass percentage):

0.06 to 0.16% C
0.05 to 0.3% Si
8 to 12% Mn
11 to 15% Cr
6 to 9% Ni
1.5 to 3.0% Al
0 to 4% Cu
0 to 0.04% B, the remainder being iron and smelting-related steel companion elements, has a stable austenitic structure.

The δ-ferrite content of the steel is less than 10 percent by volume. In the solution-annealed condition (AT), the yield strength Rp0.2 is 250 to 300 MPa at a temperature of −50° C. and in a hydrogen atmosphere of 40 MPa. The relative reduction area (=reduction of area Z in helium/reduction of area Z in hydrogen×100%) ranges between 85 and 100%. During cold forming of this steel, only a minor transformation from austenite into martensite of less than 5 percent by volume takes place with a strain of 75 percent at a forming temperature of −50° C. Therefore, this steel is characterized by a very high austenitic stability.

Thus, the steel according to the invention having a stable austenitic structure is a cost-effective, hydrogen-resistant material for use in hydrogen technology.

In particular, the steel can be used for devices and components of systems for the generation, storage, distribution and application of hydrogen, especially in cases where the devices and/or components come into contact with hydrogen. This applies, in particular, to pipes, control devices, valves and other shut-off devices, containers, heat exchangers, bosses and liners, fittings, pressure sensors etc., including parts of said devices, for example springs and bellows.

The invention relates, in particular, to steels for hydrogen technology in motor vehicles. A (high-)pressure tank, a cryogenic (high-)pressure tank or a liquid hydrogen tank made of the steel according to the invention can be used for the storage of hydrogen.

In addition, the steel is suited for applications outside of motor vehicle technology which, in the solution-annealed condition, must have a high yield strength (steel A) or require excellent cold forming capabilities or austenitic stability, in particular after cold forming (steel B).

The compositions of steels prepared according to the invention are shown by way of example in the table below. The quantities of each element contained in the steel are expressed as a mass percentage. For steel Nos. 1 to 7, the actual values are indicated; regarding steel Nos. 8 to 10, the reference values are specified.

| Steel | No. 1 | No. 2 | No. 3 | No. 4 | No. 5 | No. 6 | No. 7 | No. 8 | No. 9 | No. 10 |
|---|---|---|---|---|---|---|---|---|---|---|
| C | 0.076 | 0.076 | 0.09 | 0.11 | 0.13 | 0.10 | 0.10 | 0.12 | 0.12 | 0.12 |
| Si | 0.05 | 0.06 | 0.17 | 0.07 | 0.1 | 0.2 | 0.2 | 0.2 | 0.2 | 0.2 |
| Mn | 9.8 | 9.4 | 10.0 | 9.9 | 10.1 | 9.7 | 9.8 | 10 | 10 | 10 |
| P | | | | | | | | ≤0.030 | ≤0.030 | ≤0.030 |
| S | | | | | | | | ≤0.010 | ≤0.010 | ≤0.010 |
| Cr | 12.5 | 12.6 | 13.0 | 12.9 | 14.2 | 12.6 | 16.5 | 13 | 17 | 17 |
| Ni | 7.8 | 7.9 | 7.7 | 8.0 | 7.7 | 7.8 | 7.7 | 6 | 6 | 8 |
| Mo | | | | | | | — | — | — | — |
| N | | | | | | | — | — | — | — |
| Al | 2.9 | 2.7 | 2.7 | 2.5 | 3.9 | 2.6 | 2.8 | 2.5 | 2.5 | 1.8-2.0 |
| Cu | | | | | | | — | 3 | — | — |
| B | | | | | | 0.02 | — | — | — | — |

| Steel | No. 1 | No. 2 | No. 3 | No. 4 | No. 5 | No. 6 | No. 7 | No. 8 | No. 9 | No. 10 |
|---|---|---|---|---|---|---|---|---|---|---|
| C | 0.076 | 0.076 | 0.09 | 0.11 | 0.13 | 0.10 | 0.10 | 0.12 | 0.12 | 0.12 |
| Si | 0.05 | 0.06 | 0.17 | 0.07 | 0.1 | 0.2 | 0.2 | 0.2 | 0.2 | 0.2 |
| Mn | 9.8 | 9.4 | 10.0 | 9.9 | 10.1 | 9.7 | 9.8 | 10 | 10 | 10 |
| P | | | | | | | | ≤0.030 | ≤0.030 | ≤0.030 |
| S | | | | | | | | ≤0.010 | ≤0.010 | ≤0.010 |
| Cr | 12.5 | 12.6 | 13.0 | 12.9 | 14.2 | 12.6 | 16.5 | 13 | 17 | 17 |
| Ni | 7.8 | 7.9 | 7.7 | 8.0 | 7.7 | 7.8 | 7.7 | 6 | 6 | 8 |
| Mo | | | | | | | — | — | — | — |
| N | | | | | | | — | — | — | — |
| Al | 2.9 | 2.7 | 2.7 | 2.5 | 3.9 | 2.6 | 2.8 | 2.5 | 2.5 | 1.8-2.0 |
| Cu | | | | | | | — | 3 | — | — |
| B | | | | | | 0.02 | — | — | — | — |
| δ-ferrite (%) (calculated from analysis) | 10 | | | 21 | 6 (without B) | 18 | 7 | 19 | 8 | |
| δ-ferrite (%) measured with Feritscope | 0 | 0 | 0 | 0 | 27 | 1 | 23 | — | — | — |
| Average grain size (μm) | 39 | 38 | | | | | | — | — | — |
| Rm (MPa) air/H2 (at −50° C. 40 MPa) | 656/711 | 656/713 | 666/688 | 663/639 | 865/808 | 705/659 | 855/798 | — | — | — |
| Rp0.2 (MPa) air/H2 (at −50° C. 40 MPa) | 256/276 | 256/283 | 303/306 | 287/287 | 541/520 | 282/277 | 505/515 | — | — | — |
| Yield strength ratio air/H2 (at −50° C. 40 MPa) | 0.39/0.39 | 0.39/0.40 | 0.45/0.44 | 0.43/0.45 | 0.63/0.64 | 0.40/0.42 | 0.59/0.64 | — | — | — |
| A5 (%) air/H2 (at −50° C. 40 MPa) | 78/79 | 78/73 | 80/70.5 | 86/72 | 41/40 | 75/68 | 41/40 | — | — | — |
| Z (%) air/H2 (at −50° C. 40 MPa) | 83/69 | 83/75 | 83/71 | 80/73 | 71/62 | 79/74 | 68/67 | — | — | — |

-continued

| | | | | | | | | | | |
|---|---|---|---|---|---|---|---|---|---|---|
| RRA (%) (at −50° C. 40 MPa) | 83 | 90 | 86 | 91 | 87 | 94 | 99 | — | — | — |

Due to the low nickel content of at most 8 percent by mass and the absence of molybdenum, the steels are very cost-effective. This applies, in particular, to steel Nos. 8 and 9 with only 6 percent by mass of nickel.

All steels have high strength in a hydrogen atmosphere. For example, in a tensile test carried out at a test temperature of −50° C., a gas pressure of hydrogen of 40 MPa and a strain rate of 5×10−5 l/s, the steels in the solution-annealed condition (AT) have a small relative reduction area (RRA) of at most 83% (steel No. 1) and, in case of steel No. 7, even only 99%.

Due to the addition of 200 ppm boron, steel No. 6 has a high tensile strength (Rm) and elongation at break (A5) in a hydrogen atmosphere of 40 MPa. Since there is no formula for the calculation of the δ-ferrite content including the boron content, boron could not be taken into account when calculating the δ-ferrite content of steel No. 6.

What is also noteworthy is the high yield strength Rp0.2 of the steels in the hydrogen atmosphere both in helium and in hydrogen, in particular of the duplex steels with an austenitic-ferritic structure (Nos. 5 and 7) having a δ-ferrite content of 27 and 23 percent by mass respectively.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A corrosion-resistant, hot and cold formable and weldable steel configured in the form of dual-phase austenitic-ferritic steel for use in hydrogen technology in motor vehicles having the following composition:

0. 01 to 0.4 percent by mass of carbon,
≤3.0 percent by mass of silicon,
0.3 to 30 percent by mass of manganese,
10.5 to 17.5 percent by mass of chromium,
4 to 12.5 percent by mass of nickel,
≤1.0 percent by mass of molybdenum,
≤0.2 percent by mass of nitrogen,
0.5 to 8.0 percent by mass of aluminum,
≤4.0 percent by mass of copper,
≤1.0 percent by mass of tungsten,
≤5.0 percent by mass of cobalt,
≤0.5 percent by mass of tantalum,
≤0.1 percent by mass of boron,
≤2.0 percent by mass of at least one of the elements: niobium, titanium, vanadium, hafnium and zirconium,
0.01 to 0.2 percent by mass of yttrium, wherein yttrium can fully or partly be replaced by 0.01 to 0.2 percent by mass of scandium and/or lanthanum and/or cerium, and
the remainder being iron and smelting-related steel companion elements,
wherein the steel is resistant to hydrogen-induced embrittlement over the temperature range from −253° C. to at least +100° C., and wherein in a tensile test carried out at a test temperature of −50° C. and a gas pressure of hydrogen of 40 MPa, the steel has a relative reduction of area (RRA) of at least 90%, and a relative elongation at break (R_A5) of at least 90%.

2. The steel according to claim 1, wherein the aluminum content is 2 to 6 percent by mass.

3. The steel according to claim 1, wherein the nickel content is 4 to at most 9 percent by mass.

4. The steel according to claim 1, wherein the manganese content is 4 to 20 percent by mass.

5. The steel according to claim 1, wherein the steel contains 0.3 to 3.5 percent by mass of copper.

6. The steel according to claim 1, wherein the steel contains ≤0.40 percent by mass of molybdenum.

7. The steel according to claim 1, wherein the steel contains 0 to 0.04 percent by mass of boron.

8. The steel according to claim 1, wherein the steel contains 0.01 to 0.2 percent by mass of hafnium and/or zirconium, wherein hafnium or zirconium can fully or partly be replaced by 0.01 to 0.2 percent by mass of titanium.

9. The steel according to claim 1, wherein the steel contains up to 0.3 percent by mass of tantalum.

10. The steel according to claim 1, wherein the steel contains up to 3.0 percent by mass of cobalt.

11. The steel according to claim 1, wherein the steel has a δ-ferrite content of at least 10 percent by mass.

12. The steel according to claim 1, wherein the steel contains no added molybdenum.

* * * * *